US007635134B2

(12) United States Patent
Hedley et al.

(10) Patent No.: US 7,635,134 B2
(45) Date of Patent: Dec. 22, 2009

(54) DEVICE FOR CHANGING A VEHICULAR COMPONENT

(75) Inventors: Robert Ian Hedley, Milbrodale via Singleton (AU); Christopher Nash Whybin, Newstead (AU)

(73) Assignee: Justoy Pty Ltd (AU)

( * ) Notice: Subject to any disclaimer, the term of this patent is extended or adjusted under 35 U.S.C. 154(b) by 655 days.

(21) Appl. No.: 11/405,828

(22) Filed: Apr. 17, 2006

(65) Prior Publication Data

US 2006/0243953 A1 Nov. 2, 2006

(30) Foreign Application Priority Data

Apr. 15, 2005 (AU) ..... 2005901906

(51) Int. Cl.
*B60B 29/00* (2006.01)

(52) U.S. Cl. ..... 280/79.4; 414/426; 414/427; 414/428; 414/429

(58) Field of Classification Search ..... 414/426–429; 254/14, 105, 108, 237, 244; 280/79.4, 79.11
See application file for complete search history.

(56) References Cited

U.S. PATENT DOCUMENTS 2,364,918 A * 12/1944 Roberson ..... 414/427
2,386,516 A * 10/1945 Thompson ..... 254/8 C
2,444,992 A * 7/1948 Kittel ..... 414/427
2,490,233 A * 12/1949 Schildmeier ..... 414/427
2,551,483 A * 5/1951 Bartoe ..... 414/428
2,570,587 A * 10/1951 Noone et al. ..... 414/428
2,656,050 A * 10/1953 Best et al. ..... 242/557
2,852,151 A * 9/1958 Smith ..... 414/428
2,903,049 A * 9/1959 Carlson ..... 157/19
3,145,859 A * 8/1964 Barosko ..... 414/427
3,378,154 A * 4/1968 Mousel ..... 414/428
3,734,304 A * 5/1973 Cabaniss ..... 414/732
3,828,953 A * 8/1974 Reznicek ..... 414/428
3,830,387 A * 8/1974 Virnig ..... 414/427
3,830,388 A * 8/1974 Mott ..... 414/429
3,976,212 A * 8/1976 Sanchez ..... 414/428
4,042,139 A * 8/1977 Pernsteiner et al. ..... 414/427
4,239,196 A * 12/1980 Hanger ..... 269/17
4,401,405 A * 8/1983 Ealet ..... 414/428
4,460,306 A * 7/1984 Hawkins ..... 414/427
4,571,142 A * 2/1986 Niewald et al. ..... 414/427
4,597,711 A * 7/1986 Liebermann ..... 414/427
4,690,605 A * 9/1987 Coccaro ..... 414/429
4,732,528 A * 3/1988 Good ..... 414/802
5,007,789 A * 4/1991 Painter ..... 414/427
5,378,004 A * 1/1995 Gunlock et al. ..... 280/47.2
5,464,314 A * 11/1995 Laaksonen ..... 414/427
5,820,330 A * 10/1998 Focke et al. ..... 414/427
6,237,206 B1 * 5/2001 Bezemer et al. ..... 29/273
6,382,644 B1 * 5/2002 Rawlings ..... 280/79.4

(Continued)

*Primary Examiner*—Lesley Morris
*Assistant Examiner*—Vaughn T Coolman
(74) *Attorney, Agent, or Firm*—McAfee & Taft

(57) ABSTRACT

A device for changing a vehicular component on a first vehicle. The device includes a frame for releasably receiving a vehicular component. The frame is configured to facilitate the frame being positioned in a component changing position with respect to the first vehicle. The device also includes a first actuator for moving the frame to a first position and a second position to thereby mount the vehicular component on the first vehicle or receive the vehicular component from the first vehicle.

34 Claims, 15 Drawing Sheets

U.S. PATENT DOCUMENTS 7,207,764 B1 * 4/2007 Snook ..... 414/427
7,334,804 B2 * 2/2008 Mitchell et al. ..... 280/79.4
2003/0095854 A1 * 5/2003 Abela ..... 414/426
2005/0074316 A1 * 4/2005 Hedley et al. ..... 414/426

* cited by examiner

DEVICE FOR CHANGING A VEHICULAR COMPONENT

BACKGROUND OF THE INVENTION

The present invention generally relates to devices for changing vehicular components such as wheels and engines.

DESCRIPTION OF THE PRIOR ART

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

A number of devices are known which can be used for changing vehicular components. A common device used for such purposes is a jack that is placed underneath a vehicle and used to elevate the vehicle off the ground such that a wheel can be replaced. A jack is generally placed substantially near the exterior perimeter of the vehicle such that the wheel may be removed from the axle.

However, in situations where the vehicle includes at least two tyres on a common axle, such as is the situation with large machinery and vehicles, and an inner wheel needs to be changed, the internal wheel may not easily be accessed, because a confined space exists between the wheels on adjacent axles.

Thus, there exists a need for a device that is capable of aiding the changing of vehicular components in confined spaces that address or at least ameliorate problems inherent in the prior art.

SUMMARY OF THE INVENTION

In a first broad form, the present invention provides a device for changing a vehicular component on a first vehicle, the device including:

- a frame for releasably receiving a vehicular component;
- a mounting member coupled to the frame for allowing the device to be mounted to a second vehicle such that the second vehicle can position the device in a component changing position with respect to the first vehicle; and,
- a first actuator for moving the frame between a first position and a second position to thereby mount the vehicular component on the first vehicle or receive the vehicular component from the first vehicle.

In a second broad from the present invention provides a device for changing a vehicular component on a first vehicle, the device including:

- a frame for releasably receiving a vehicular component, wherein the frame is configured to facilitate the frame being positioned in a component changing position with respect to the first vehicle; and
- a first actuator for moving the frame to a first position and a second position to thereby mount the vehicular component on the first vehicle or receive the vehicular component from the first vehicle.

In one particular, but non-limiting, form, the device includes a mounting member coupled to the frame for allowing the device to be mounted to a second vehicle such that the second vehicle can facilitate positioning the device in the component changing position.

In another particular, but non-limiting, form, the componet changing position is a location between adjacent axles of the first vehicle.

In one embodiment, the actuator moves the frame to the first position, wherein the frame is located distally from one of the axles of the first vehicle, and the second position, wherein the frame is located adjacently the one of the axles of the first vehicle.

In another embodiment, the frame is elongate such as to facilitate the frame being positioned between the adjacent axles of the first vehicle.

In one optional embodiment, the device includes a support structure which is operably connected to the frame for supporting the frame.

In another optional embodiment, the support structure is elongate to facilitate the positioning of the device between adjacent axles.

Optionally, the support structure includes at least one support wheel to allow movement of the device in multiple directions.

Also optionally, the frame includes one or more support members which support the vehicular component within the frame.

In one aspect, the one or more support members include one or more rollers.

In another aspect, the one or more rollers includes one or more support rollers which the vehicular component received within the frame rests upon, and one or more retainment rollers which engage a portion of the vehicular component to facilitate retainment of the vehicular component within the frame.

In one embodiment, the one or more rollers facilitate rotation of the vehicular component within the frame.

In another embodiment, the device includes a roller actuator, wherein actuation of the roller actuator causes the one or more rollers to rotate thereby facilitating rotational movement of the vehicular component within the frame.

In one particular, but non-limiting, form, the device includes a retainment roller actuator, wherein actuation of the retainment roller actuator causes the one or more retainment rollers to move between a disengaged position, wherein the vehicular component supported within the frame is able to be removed from the frame, and a retainment position, wherein the vehicular component is retained within the frame.

In another particular, but non-limiting, form, the device includes a locking member which is operably connected to the frame, wherein the locking member moves between an unclamped position, wherein the vehicular component is able to be released from the frame, and a clamped position facilitating retainment of the vehicular component within the frame.

In one form, the locking member in the retainment position causes the locking member to engage with a portion of the vehicular component to restrict rotation of the vehicular component within the frame.

In another form, the device includes a locking member actuator, wherein actuation of the locking member actuator causes the locking member to move between the unclamped position and the clamped position.

In one optional embodiment, the frame includes a separable side bar member, wherein the separable side bar is moveable between a first position to facilitate release of the vehicular component from the frame, and a second position to facilitate retainment of the vehicular component within the frame.

In another optional embodiment, the frame include a profile which substantially corresponds to profile of the vehicular component to facilitate retainment of the vehicular component within the frame.

Optionally, the frame includes a profile which substantially corresponds to a wheel.

Also optionally, the device includes a removeable cradle which when is, wherein the cradle is able to engage a vehicular component within the frame.

In one aspect, the cradle is engageable with an engine.

In another aspect, second vehicle is a bulldozer, and the mounting member is mountable with a grader of the bulldozer.

In one embodiment, the device includes a moveable plate which is operably connected to the support structure and frame, wherein actuation of the first actuator causes the moveable plate to move relative to the mounting member, causing the frame to move between the first position and second position.

In another embodiment, the moveable plate is moveably mounted to the support structure to permit movement of the support structure and frame relative to the moveable plate.

In one form, the device includes a second actuator which is located between the moveable plate and the support structure, wherein actuation of the second actuator causes the frame to rotate about an axis of the moveable plate.

In another form, the device includes a third actuator operably connected between the support structure and the frame, wherein actuation of the third actuator adjusts an elevation of the frame relative to a support surface.

In one aspect, the device includes a fourth actuator operably connected between the support structure and the frame, wherein actuator of the fourth actuator causes rotational movement of the frame relative to the support structure.

In another aspect, the device includes a fifth actuator provided between the support structure and the moveable plate, wherein actuation of the fifth actuator causes the support structure and frame to extend away from the moveable plate or move toward the moveable plate.

In one optional embodiment, at least one of the first actuator, the second actuator, the third actuator, the fourth actuator and the fifth actuator are a piston and cylinder arrangement.

In another optional embodiment, the cradle include cradle engagement members which engage the cradle within the frame.

In a further optional embodiment, the device includes cradle fasteners to fasten the vehicular component to the cradle.

In another form, the device includes at least one moveable member, wherein the frame is connected to the support structure via the at least one moveable member which is able to move along legs of the support structure so as to alter the elevation of the frame relative to the support structure.

DESCRIPTION OF THE DRAWINGS

The present invention should become apparent from the following description, which is given by the way of example only, of a preferred but non-limiting embodiment thereof, described in connection with the accompanying figures.

FIG. 1(*b*) shows a further perspective view of the device of FIG. 1(*a*).

FIG. 2(*b*) shows a reverse perspective view of the device of FIG. 1(*a*) being positioned using a second vehicle.

FIG. 2(*c*) shows a magnified perspective view of the device of FIG. 1(*a*) being positioned using a second vehicle.

FIG. 3(*b*) shows a perspective view of the device of FIG. 1(*a*) where the frame in the first position.

FIG. 3(*c*) shows a perspective view of the device of FIG. 1(*a*) where the frame in the second position.

FIG. 5(*b*) shows a top view of the device of FIG. 1(*a*) where the frame is rotated.

FIG. 7(*b*) shows a magnified perspective view of the device of FIG. 1(*a*) including a cradle supporting an engine.

FIG. 7(*c*) shows a perspective view of the device of FIG. 1(*a*) including a cradle supporting an engine where the cradle and engine are rotated.

DETAILED DESCRIPTION OF THE PREFERRED EMBODIMENTS

Figure 1A:
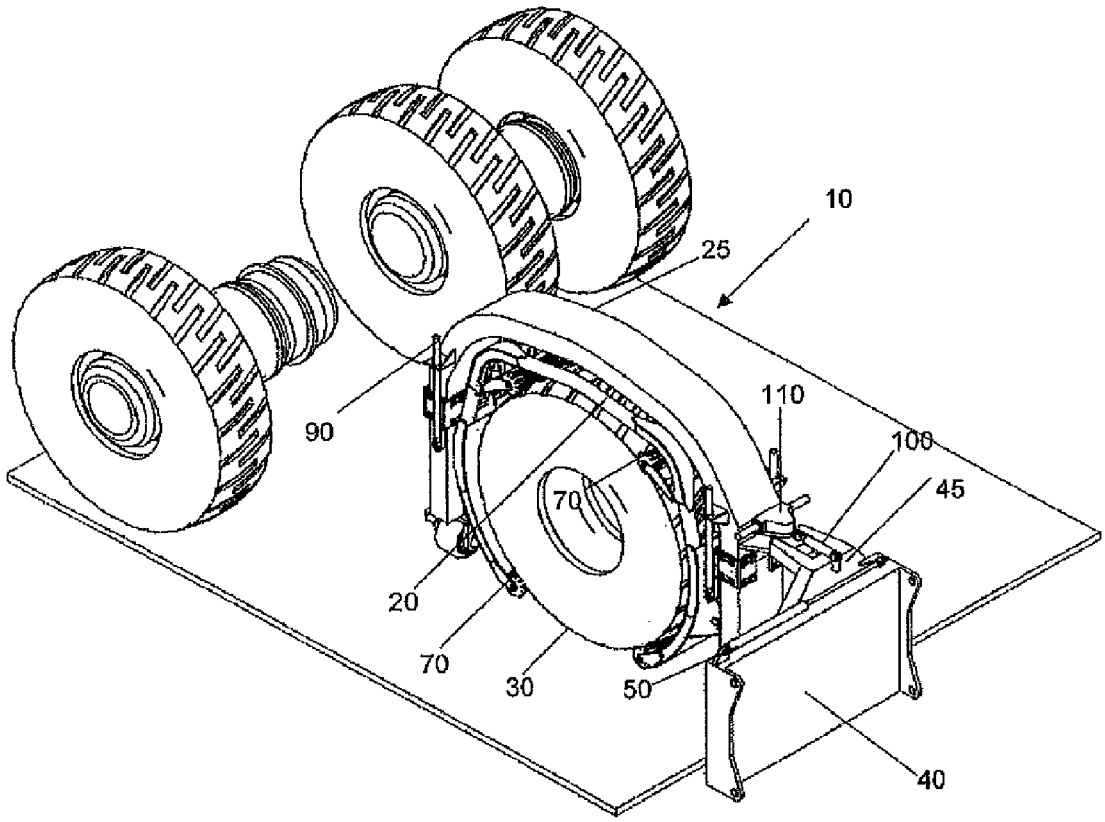
FIG. 1(*a*) shows a perspective view of an example of a device for changing a vehicular component.

The following embodiments, given by way of example only, are described in order to provide a more precise understanding of the subject matter of a preferred embodiment or embodiments.

In the figures, incorporated to illustrate features of an example embodiment, like reference numerals are used to identify like parts throughout the figures.

Figure 1B:
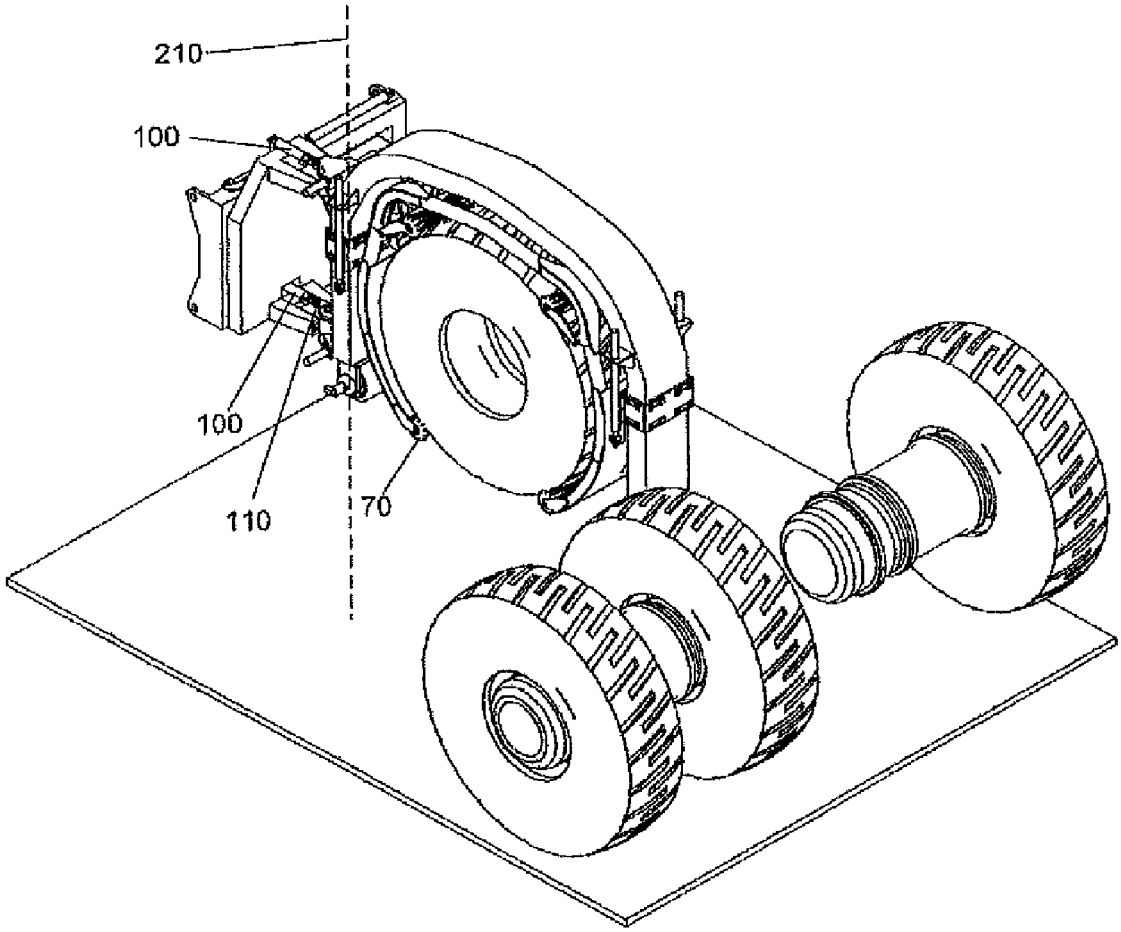

An example of a device for changing a vehicular component on a vehicle will now be described with reference to FIGS. 1(*a*) and 1(*b*).

The device 10 includes a frame 20 for releasably receiving a vehicular component 30, wherein the frame 20 is configured to facilitate the frame being positioned in a component changing position with respect to the first vehicle. The device 10 also includes a first actuator 50 for moving the frame 20 between a first position and a second position to thereby mount the vehicular component on the first vehicle or receive the vehicular component from the first vehicle. In one form, the device includes a mounting member 40 for releasably mounting the device to a second vehicle 200.

Figure 2A:
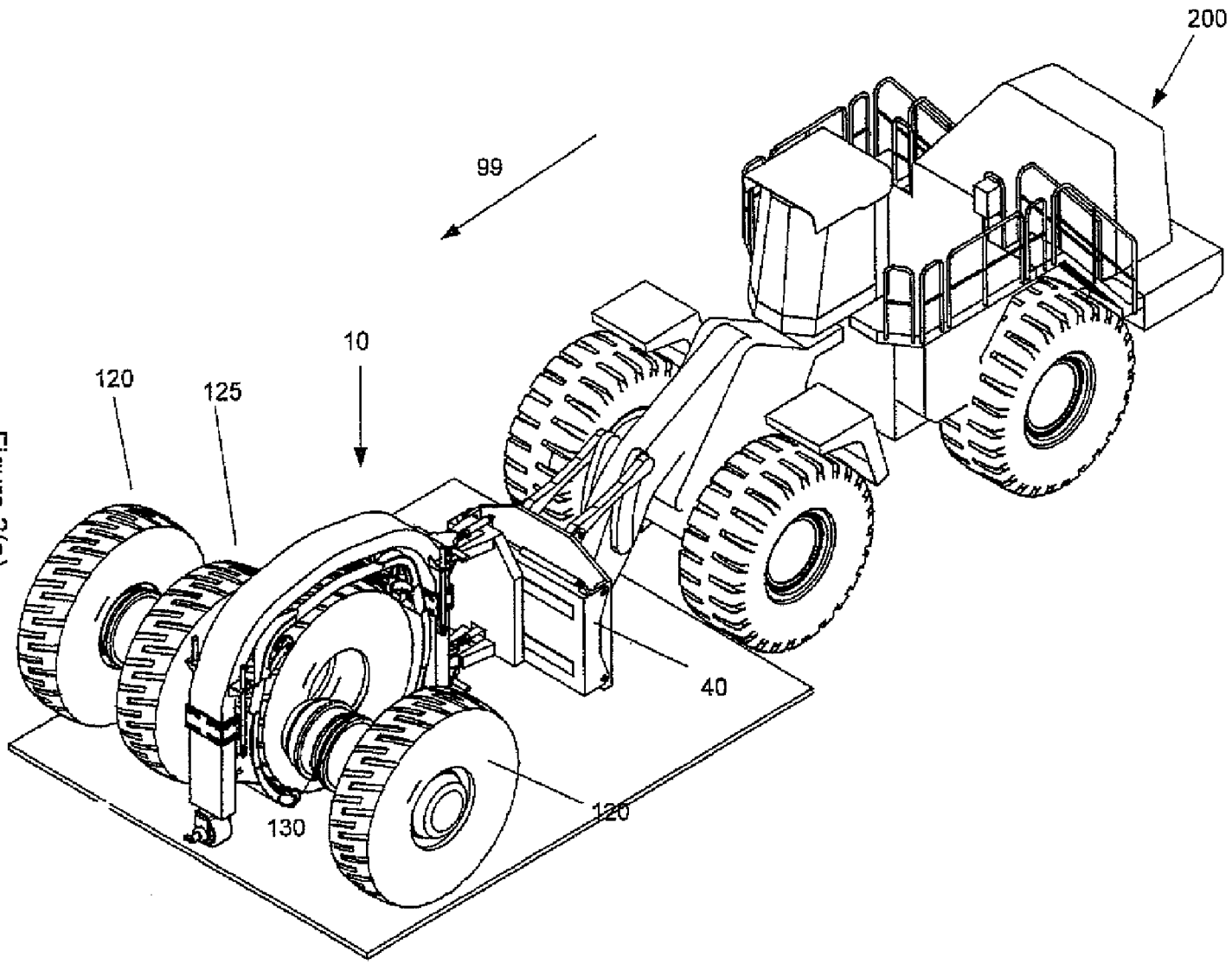
FIG. 2(*a*) shows a perspective view of the device of FIG. 1(*a*)being positioned using a second vehicle.
Figure 2B:
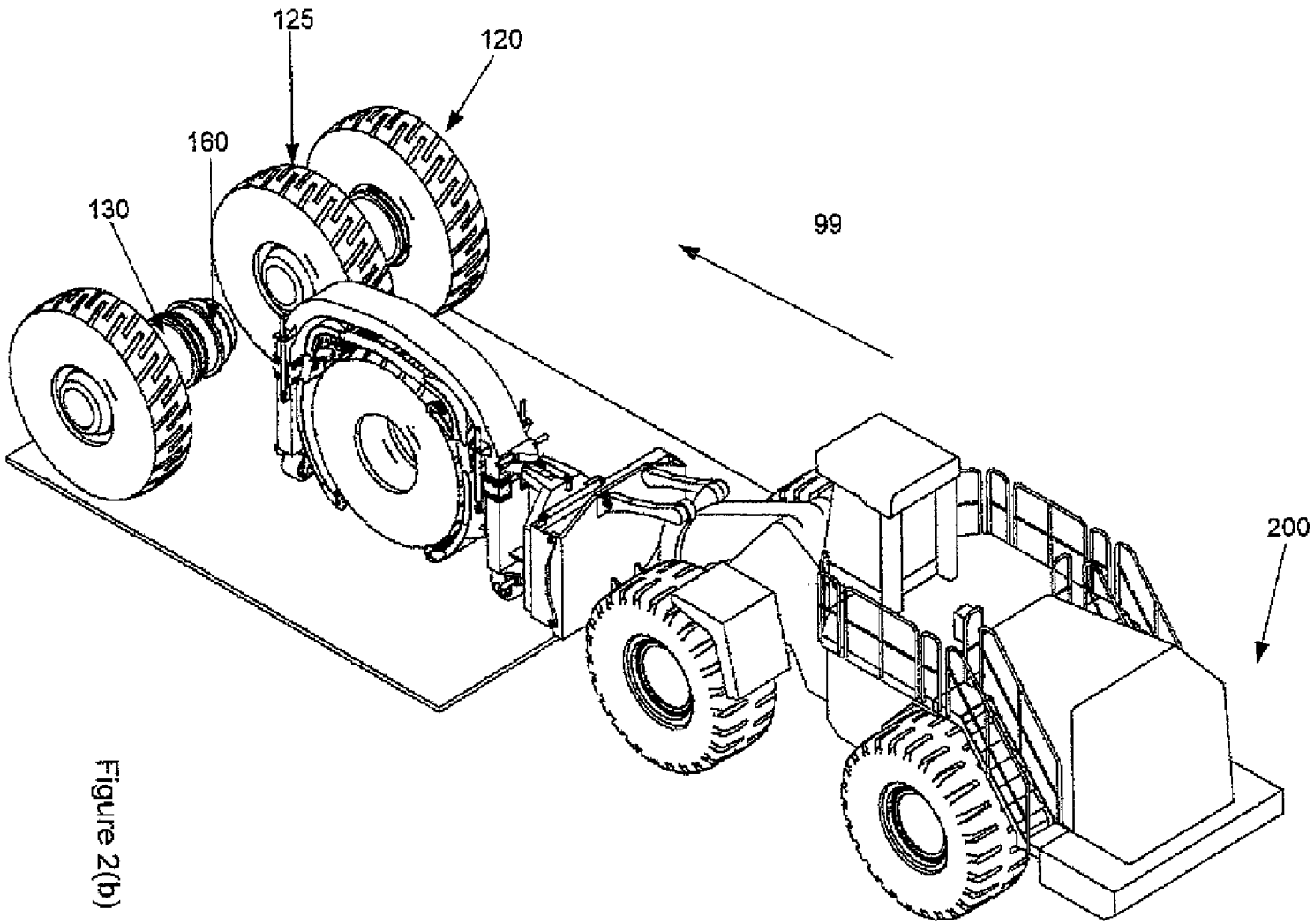
Figure 2C:
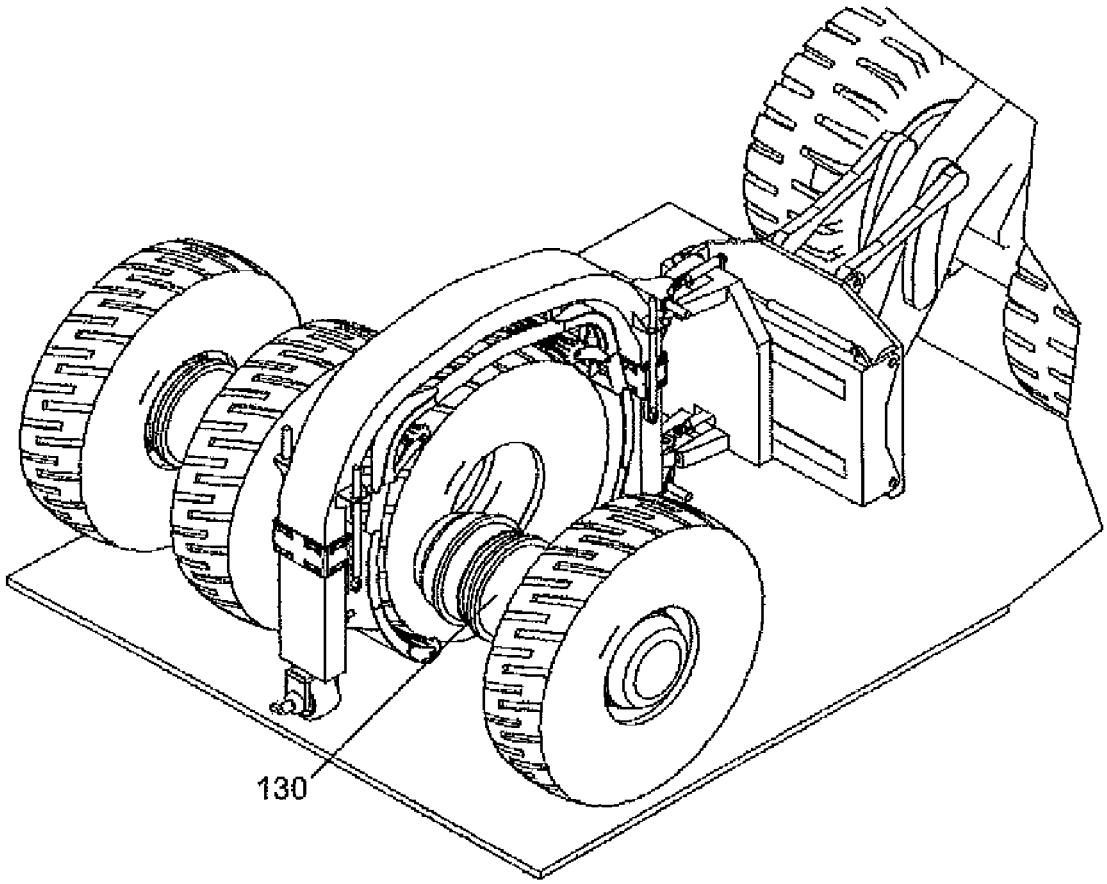

As shown in FIGS. 2(*a*) and 2(*b*), the device 10 is able to be positioned in a confined space between adjacent axles 130 of the first vehicle. The second vehicle 200 mounted to the mounting member 40 positions the device 10 in a component changing position within the confined space, as represented by arrows 99 in FIGS. 2(*a*) and 2(*b*). When the device 10 is placed in the component changing position, the frame 20 is substantially aligned with at least one of the adjacent axles 130.

Figure 3A:
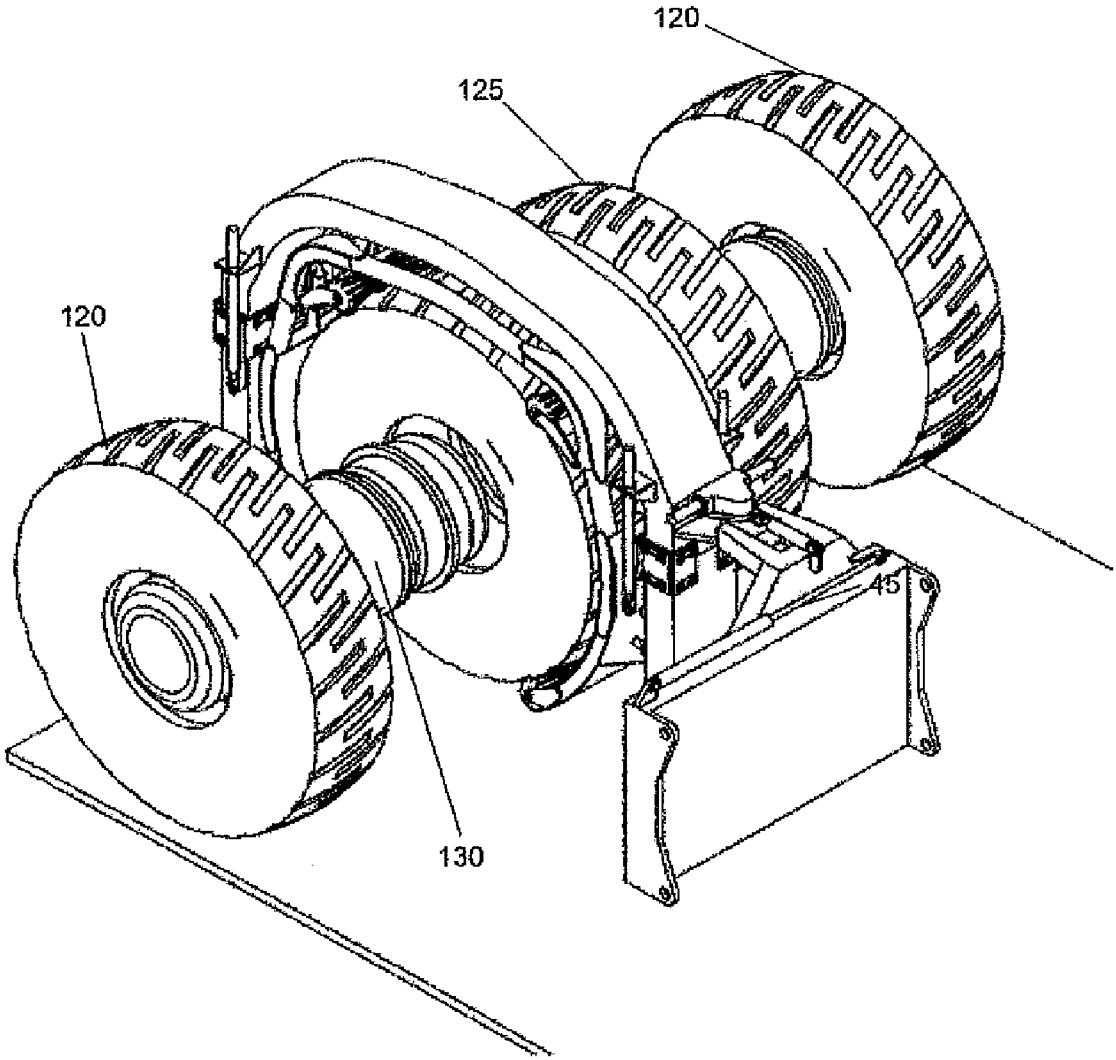
FIG. 3(*a*) shows a perspective view of the device of FIG. 1(*a*) in the component changing position.
Figure 3B:
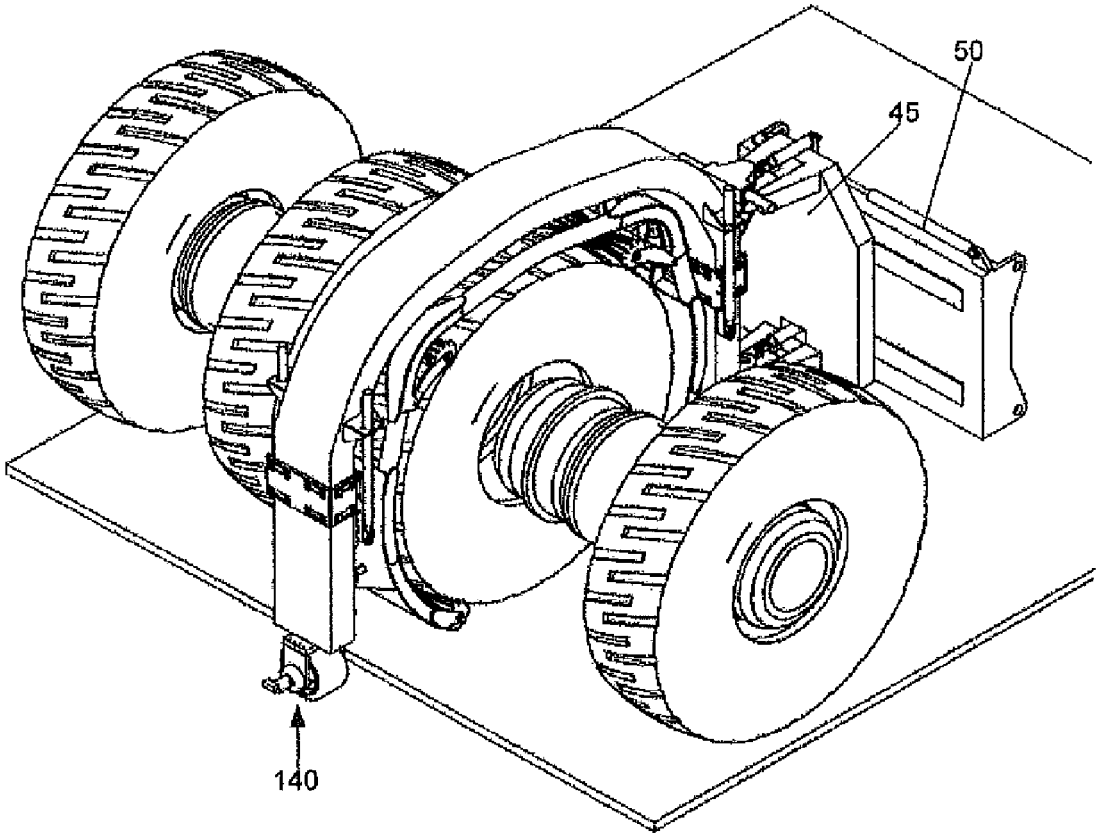
Figure 3C:
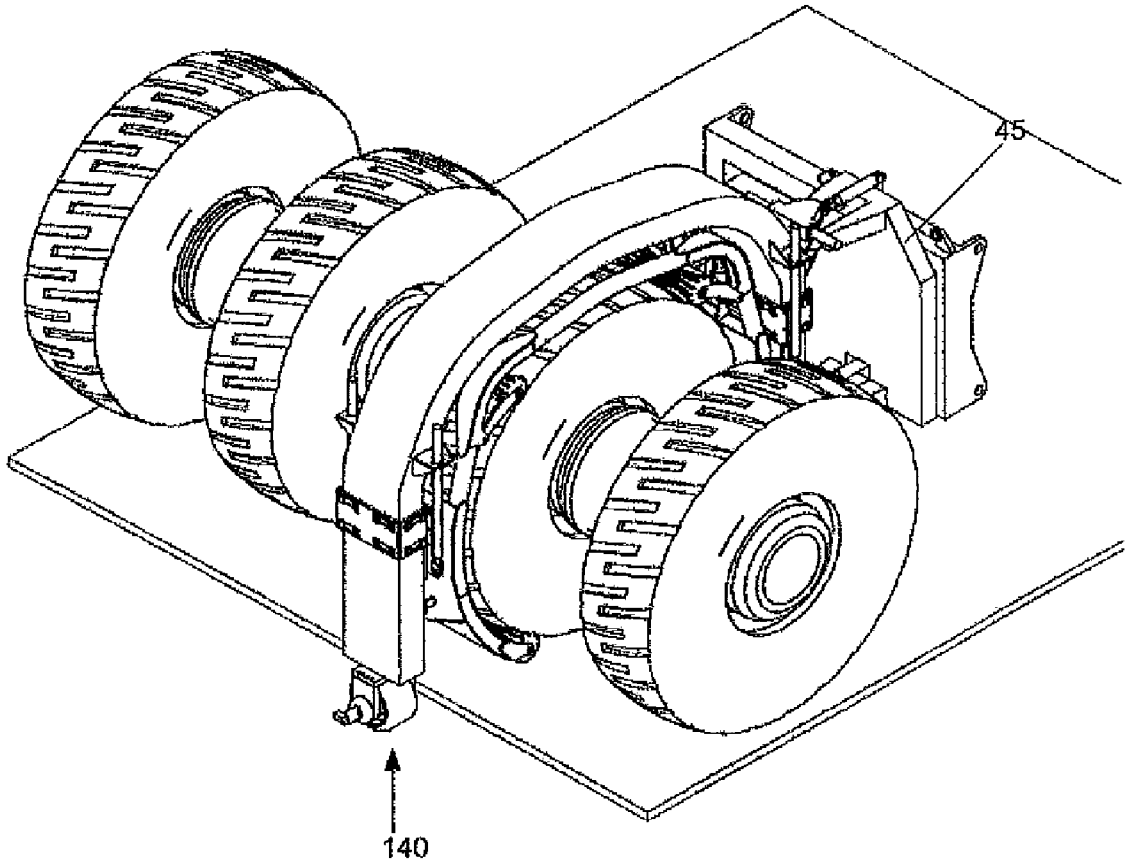

Once the device 10 is positioned in the component changing position, the frame 20 is moved from a first position to a second position such that the vehicular component 30 can be mounted on the first vehicle or received from the first vehicle. When the frame is positioned in the first position, the frame 20 is positioned distally from one of the axles 130 of the first vehicle, as shown in FIG. 3(*b*). When the first actuator 50 is actuated, the frame 20 is moved from the first position to the second position where the frame is located adjacent one of the axles 130 such that the vehicular component 30 can be mounted to the first vehicle or removed from the first vehicle, as shown in FIG. 3(*c*).

When a vehicular component 30 is to be mounted to the first vehicle, the frame 20 supports the vehicular component 30 whilst the device is being placed in the component changing position. Once the device 10 is placed in the component changing position, the first actuator 50 can be actuated to move the frame 20 between the first position and the second position.

Alternatively, if a vehicular component 30 is to be received from the first vehicle, the device 10 is positioned in the component changing position such that the frame 20 can be moved from the first position to the second position so that the frame 20 receives the vehicular component 30 from the first vehicle in the second position. Then the first actuator 50 can be actuated again so as to cause the frame 20 to move from the second position back to the first position, allowing the vehicular component 30 to be disengaged from with the first vehicle. The device 10 can then be removed from the component changing position between the adjacent axles by reversing the second vehicle 200 allowing easy removal of the vehicular component from between the adjacent axles 130 of the first vehicle.

The device 10 allows a vehicular component 30 to be mounted or removed to or from the vehicle in a confined space, which in this example is the gap between adjacent wheels 120, 125 and/or axles 130 of the first vehicle. Generally, by positioning the device 10 in the component changing position between adjacent axles 130, an inner wheel 125 on an axle 130 or an engine 160 for a particular wheel (as will be described in more detail later) can be easily changed, removed or mounted without having to remove the external wheel 120 of the first vehicle.

Referring back to FIG. 1(*a*), the frame 20 is an elongate structure which allows the device to be positioned between the adjacent axles 130 of the first vehicle. The frame 20 is connected to a support structure 25 via moveable members 27 which are able to move along legs 26 of the support structure 25. In one form, the moveable members 27 are slidable members which encircle the legs 26 of the support structure, where the slidable members slide in a substantially vertical orientation along the legs 26 of the support structure.

The slidable members can includes guide members 28 to guide the movement of the moveable members 27 along the legs 26 of the support structure 25. In one form, the guide members 28 may take the form of guide rollers which facilitate the slidable movement of the moveable member 27 along the legs 26.

Figure 4:
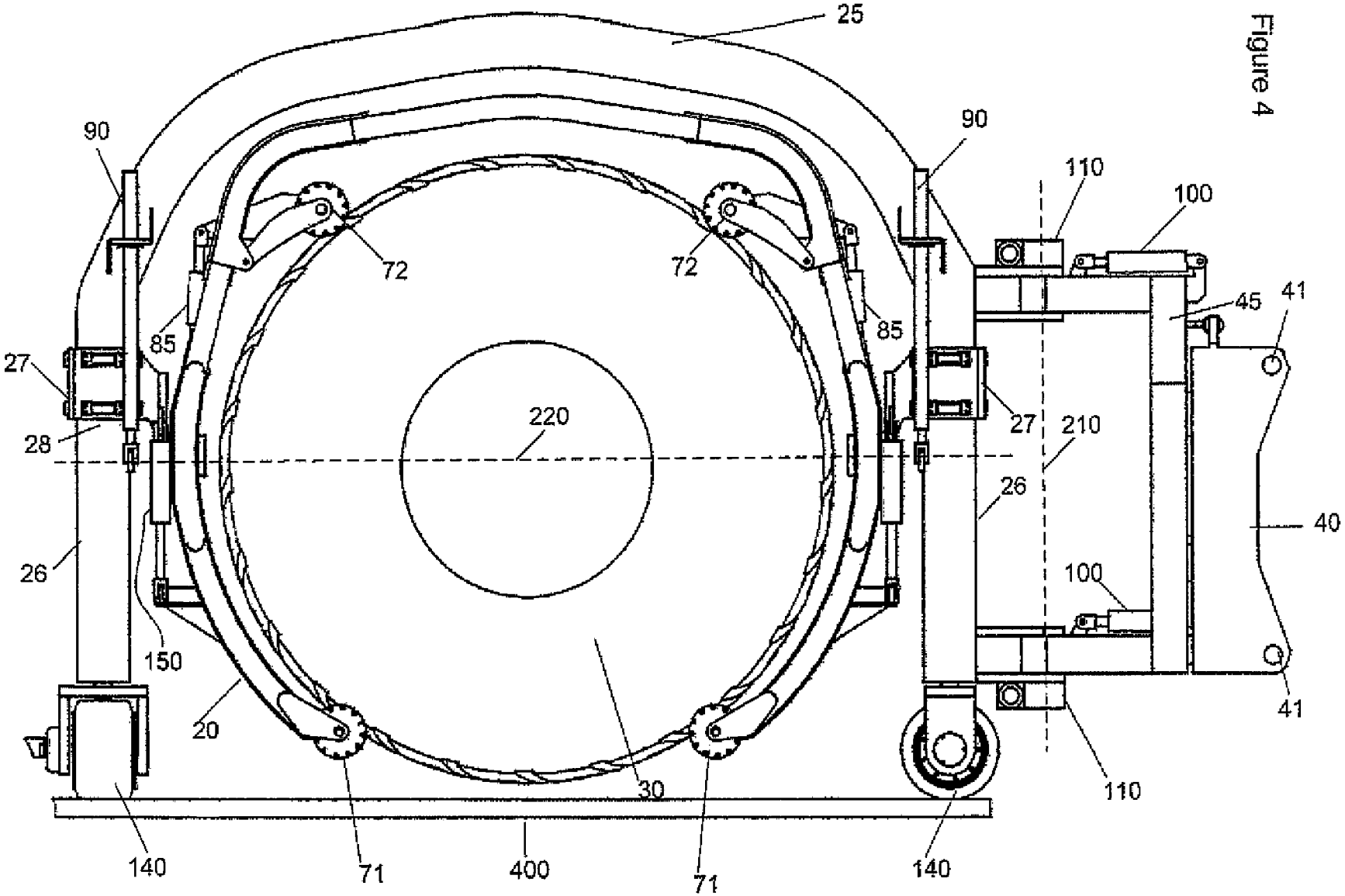
FIG. 4 shows a side view of the device of FIG. 1(*a*) retaining a wheel.

The support structure 25 is similarly an elongate shape such that the support structure 25, including the frame 20, can be positioned between adjacent axles 130. The support structure 25 generally includes at least one support wheel 14, as shown more clearly in FIG. 4, for supporting the support structure 25 and the frame 20 on a supporting surface 400. As depicted in FIG. 4, the support structure 25 includes two wheels extending from the legs 26 of the support structure 25. The support wheels 140 provide movement in multiple directions. In one form, the at least one support wheel 140 is pivotally connected to the support structure 25 such as to allow movement is multiple directions.

The frame 20 generally includes one or more support members 70, which can be provided in the form of rollers 70 which support and retain a received vehicular component 30. As shown in FIG. 4, the frame 20 includes at least one support roller 71 which the vehicular component 30 rests upon, and additionally at least one retainment roller 72 which is actuated by a retainment roller actuator 85 to cause the retainment roller to move between a disengaged position and a retainment position where the retainment roller clamps against a portion of the vehicular component 30, thereby engaging the vehicular component 30 within the frame 20.

The rollers 71, 72 permit the vehicular component to rotate within the frame 20 by rotating on the external surface of the respective rollers 71, 72. This can be advantageous when a component needs to be rotated within the frame, for example aligning lugs and holes of a vehicular component with a portion of the first vehicle.

The frame 20 can generally include a profile similar to the shape of the received vehicular component 30. Thus, as shown in FIG. 4, the frame 20 includes a profile which substantially corresponds to the shape of a wheel so as to provide additional retainment of the wheel within the frame.

The mounting member 40 is capable of being releasably mounted to a second vehicle 200, so that the second vehicle 200 can position the device 10 in the component changing position. As shown in FIG. 4, the mounting member may include a mounting means in the exemplary form of one or more holes 41 that can be used to engage a portion of the second vehicle 200. The mounting member 40 may be shaped to receive a particular component of the second vehicle 200. For example, as shown in FIGS. 2(*a*), 2(*b*) and 2(*c*), the mounting member 40 is adapted to mount a bulldozer grader.

Referring to FIGS. 2(*a*), 2(*b*) and 2(*c*), the support structure is indirectly connected to the mounting member 40 via a moveable plate 45. As can be seen in FIGS. 3(*a*), 3(*b*) and 3(*c*), the first actuator 50 is located between the mounting member 40 and the moveable plate 45, wherein the moveable plate is connected to the support structure 25 and frame 20. On activation of the first actuator 50, the moveable plate 45 moves relative to the mounting member 40, moving the frame 20 and support structure 25 from the first position to the second position, or reversely from the second position to the first position.

The support structure 25 is moveably mounted to the moveable plate 45 such that the support structure 25, including the frame 20, may be repositioned relative to the moveable plate 45. This relative movement is accomplished using a number of actuators located on the moveable plate 45 and/or the support structure 25.

Figure 5A:
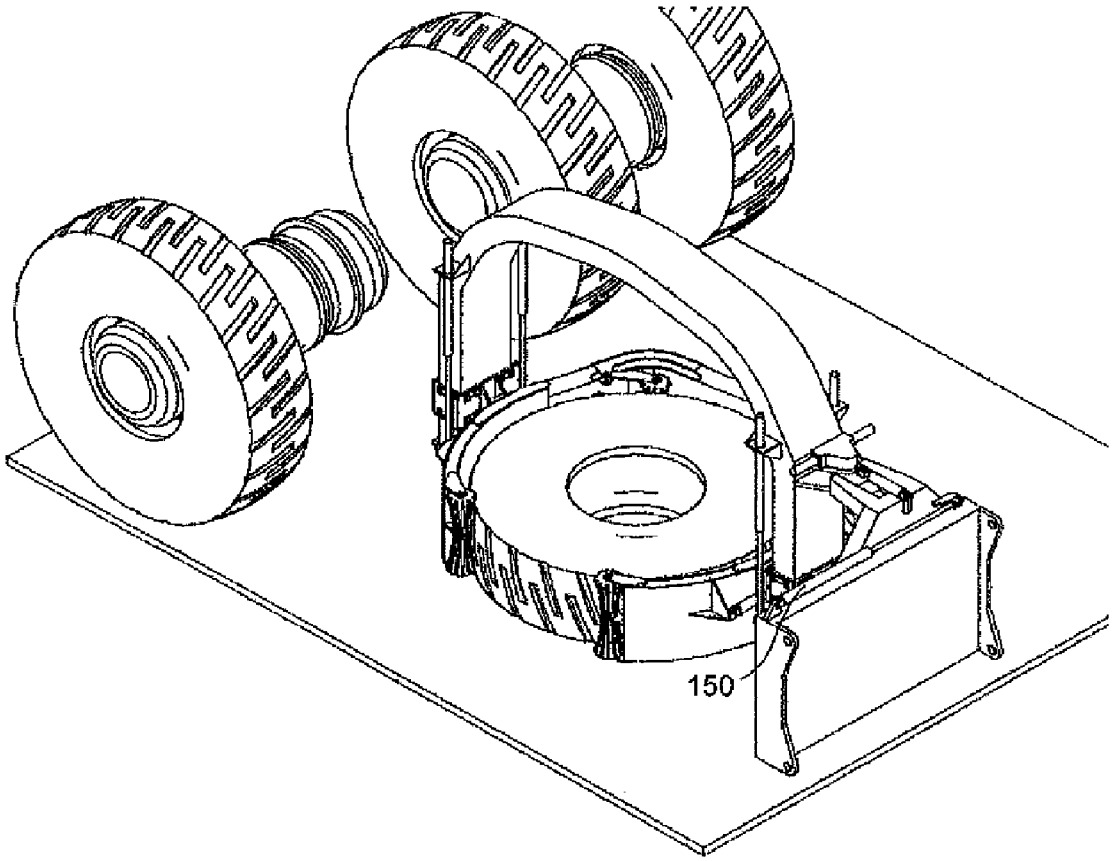
FIG. 5(*a*) shows a perspective view of the device of FIG. 1(*a*) where the frame is rotated.
Figure 5B:
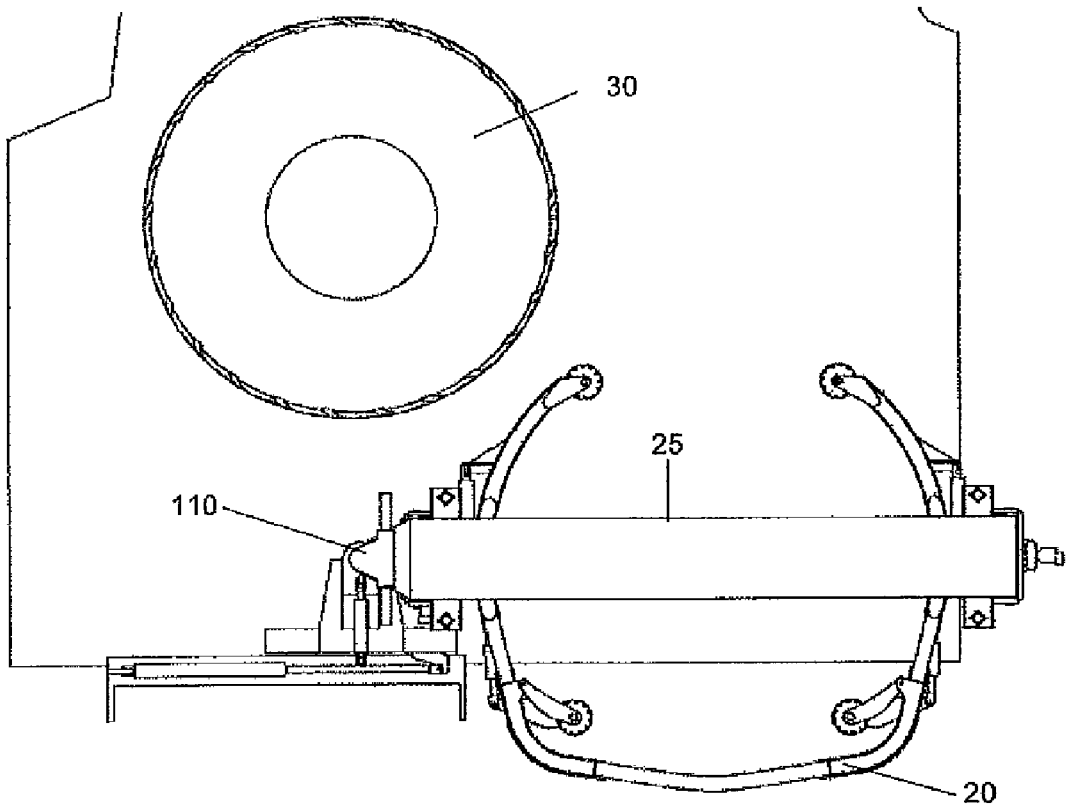
Figure 6:
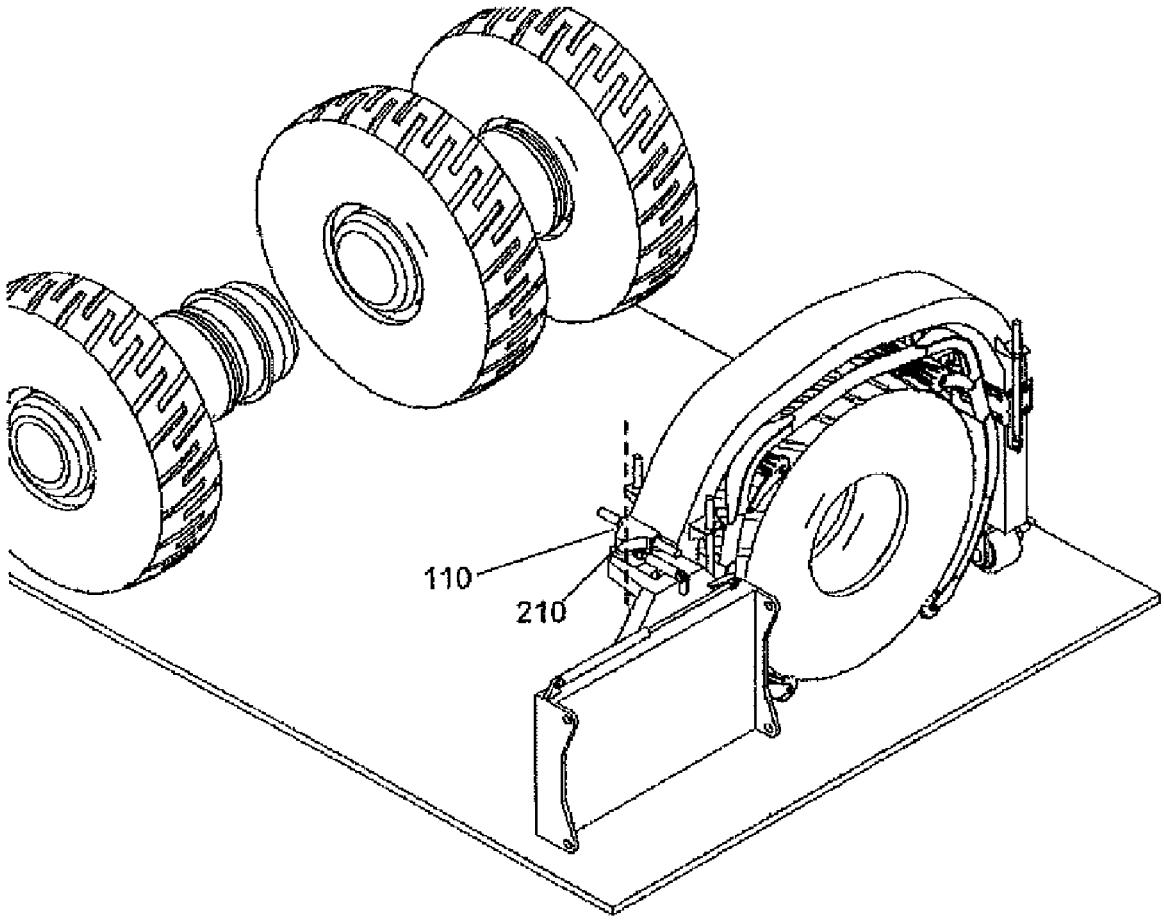
FIG. 6 shows a perspective view of the device of FIG. 1(*a*) where the support structure is rotated.

The device can include one or more second actuators 110 positioned between the moveable plate 45 and the support structure 25 to rotate the frame 20 about an axis 210, as shown in FIGS. 4, 5(*b*) and 6. A plurality of second actuators 110 may be placed at opposite ends of the moveable plate 45 such as to facilitate the rotational movement of the support structure 25 about the axis 210.

The device can also include one or more third actuators 90 located between each moveable member 27 and the support structure 25 so as to adjust the elevation of the frame 20 relative to the supporting surface.

The device can also include one or more fourth actuators 150 for rotating the frame 20 about a frame axis 220 as shown in FIG. 4. The fourth actuator 150 is pivotally coupled to the moveable member 27 of the support structure 25 and the frame 20. The ends of the fourth actuators are offset relative to the frame axis 220. When the fourth actuator 150 is in a first state, the frame is located in a substantially vertical orientation, as shown in FIG. 4. When the fourth actuator is actuated, the offset of the fourth actuator 150 causes a rotational moment about the frame axis 220, thereby rotating the frame 20. Whilst the frame 20 rotates, coupled ends of the fourth actuator 150 pivot relative to the moveable member 27 and frame 20. When the fourth actuator is in a second state, the frame is positioned in a substantially horizontal orientation, as shown in FIGS. 5(*a*) and 5(*b*).

As shown in FIG. 5(*a*), the frame 20 may be rotated such that the frame 20 may receive a vehicular component 30 in an alternate position to that which the vehicular component 30 is mounted on the first vehicle. For example, when a side-wall of a wheel is resting upon a supporting surface as shown in FIG. 5(*a*), the frame 20 may be rotated about the frame axis 220 such as to releasably receive the wheel.

The device can also include one or more fifth actuators 100 located between the support structure 25 and the moveable plate 45. Actuation of the fifth actuator 100 can cause the support structure 25 to extend away from the moveable plate 45, or reversely can cause the support structure 25 to move toward the moveable plate. The fifth actuator 100 can be used to accurately align the device with an axle 130 when the second vehicle is unable to perform such accurate alignment.

Figure 7A:
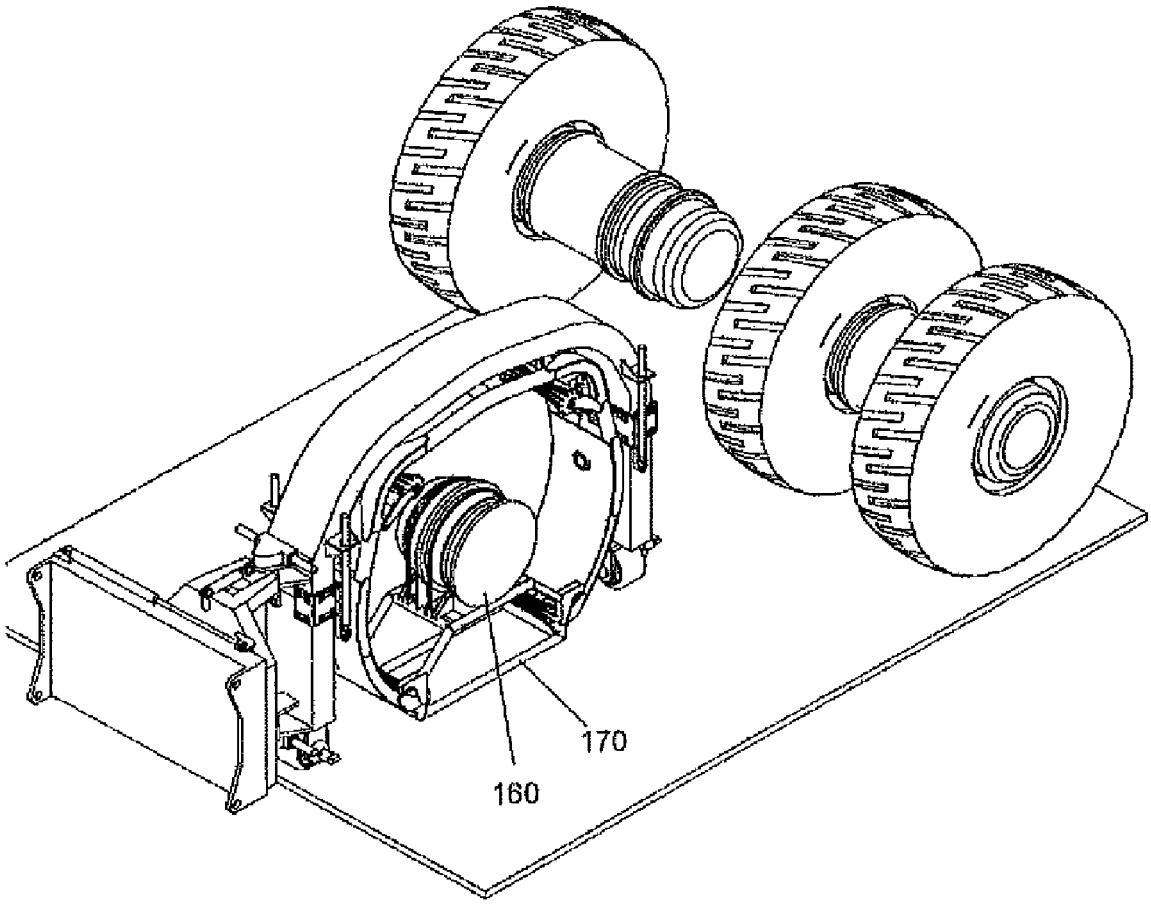
FIG. 7(*a*) shows a perspective view of the device of FIG. 1(*a*) including a cradle supporting an engine.
Figure 7B:
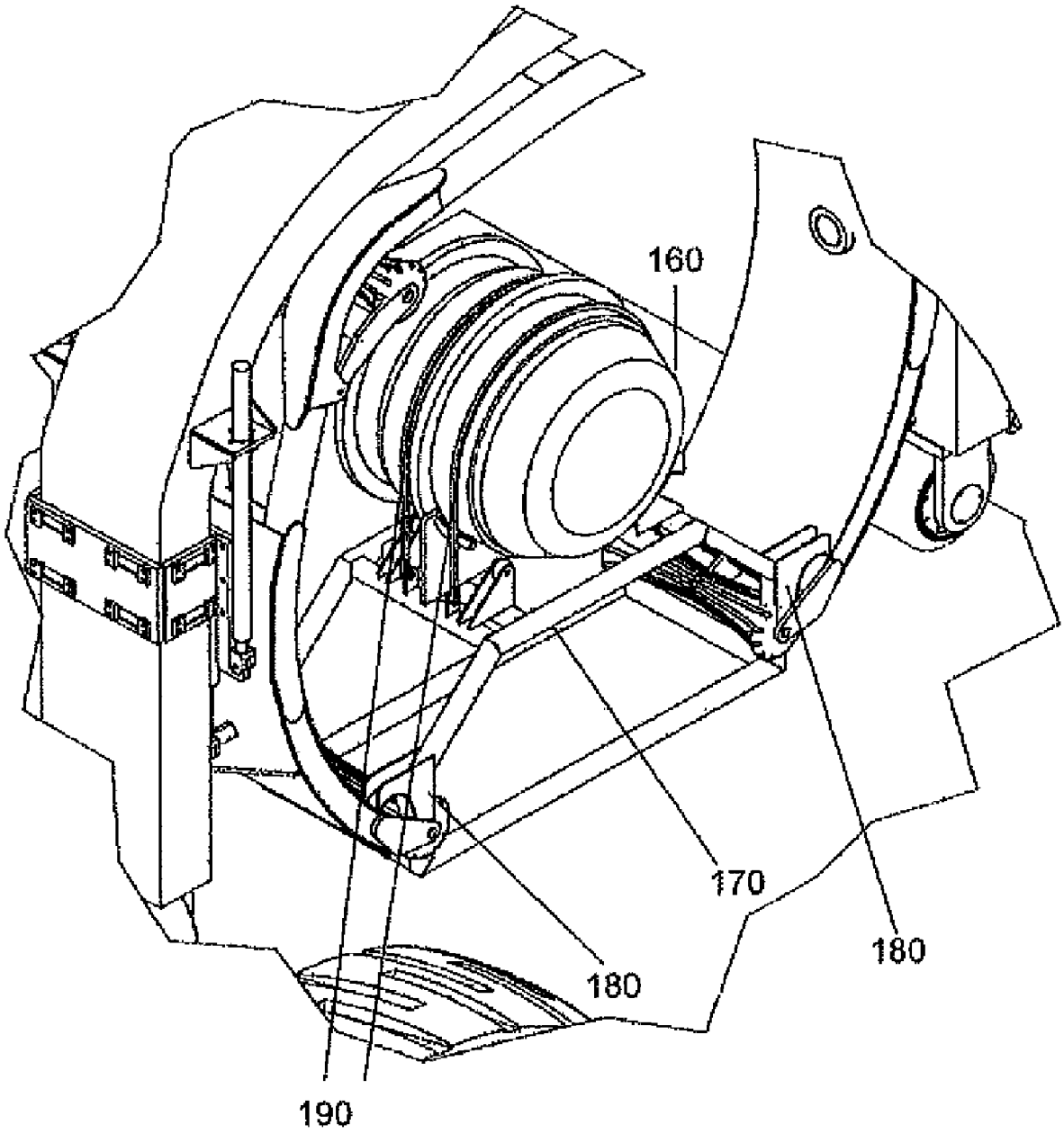
Figure 7C:
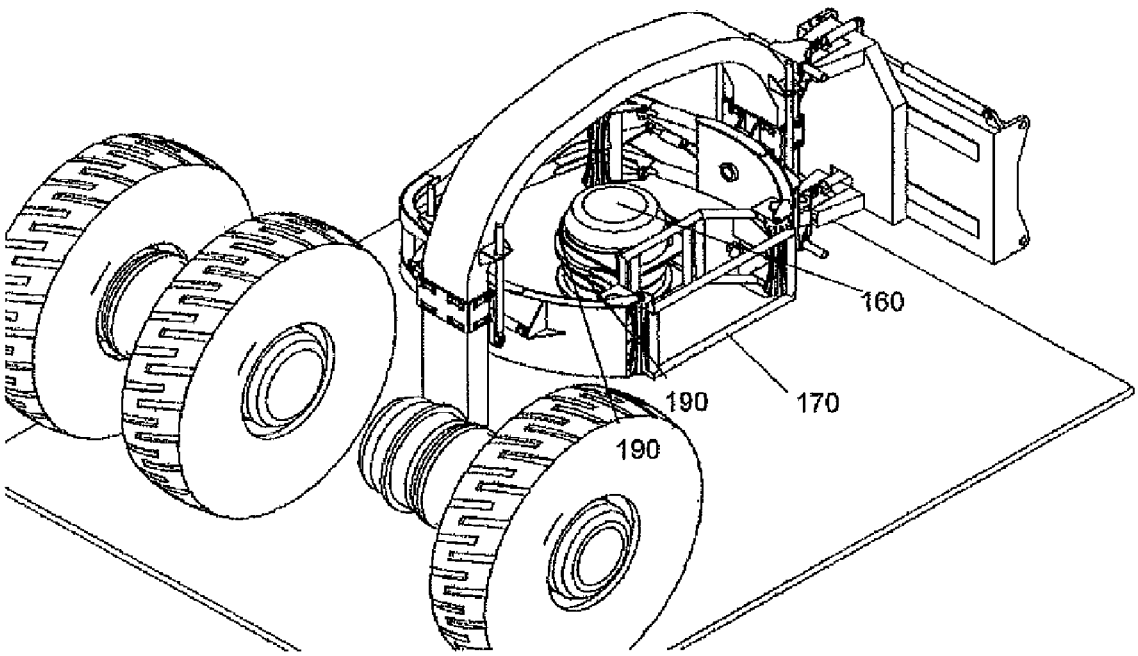

As shown in FIGS. 7(*a*), 7(*b*) and 7(*c*), the device can include a separable cradle 170 which engages with a portion of the frame 20 so that a vehicular component such as an engine 160 may be releasably received by the frame 20 and cradle 170 in order to manoeuvre, receive and/or mount an engine 160 onto or from the first vehicle.

In particular regard to large machinery, each wheel or pair of wheels may be driven by an independent or dedicated engine 160. In such situations, a respective engine 160 for a particular wheel or pair of wheels may also need to be changed. Thus, the device 10 can be positioned between adjacent axles 130 of a vehicle to change an engine 160 of the first vehicle.

As shown in FIGS. 7(*a*) and 7(*b*), the cradle 170 may releasably engage with the rollers 70 of the frame 20 such as to support the engine 160. The cradle 170 engages with the rollers 70 using cradle engagements 180. The engine 160 is supported in the cradle 170 and may be retained to the cradle 170 using fasteners 190. Once the engine 160 has been fastened to the cradle 170, the cradle 170 can be rotated using the various actuators previously discussed by rotating or manoeuvring the frame 20.

It will be appreciated that a number of different actuators may be used. Generally, for example, the actuators may be in the form of a piston and cylinder arrangement which move using hydraulics. It will be appreciated that other forms of actuators could also be used. A controller may also be provided with the device 10 to control the actuation of each actuator.

In one optional embodiment, the device 10 may include a transportation mechanism such as an engine to facilitate the positioning of device in the component changing position. In this optional embodiment, the device 10 does not necessarily require a mounting member to allow positioning of the device using the second vehicle 200 due to the transportation mechanism performing the functionality.

Additionally or alternatively, retainment of the vehicular component 30 can be further provided using a locking member. The locking member pivotally extends from a portion of the frame 20. The locking member can be actuated by a locking member actuator such that the locking member moves between an unclamped position to permit the release of the vehicular component, and a clamped position where the clamping member clamps onto an exterior surface of the vehicular component 30.

In another optional embodiment, the frame 20 can include a seperable side bar member 86, as shown in FIG. 9. The separable side bar member 86 is moveable between a first position to facilitate release of the vehicular component 30 from the frame 20, and a second position to facilitate retainment of the vehicular component 30 within the frame 20.

In one form, the separable side bar member 86 may include a plurality of portions 87, wherein the portions 87 engage together with the frame 20. When a vehicular component 30 is to be received by the frame 20, the side bar member 86 is separated from the frame 20 such that a gap exists in the frame 20 to allow the frame 20 to receive the vehicular component 30. Once the vehicular component 30 has been received, the side bar member 86 re-engages with the frame 20.

In an alternative embodiment, the first actuator 50 may be located remotely on the second vehicle 200, wherein the second vehicle 200 manoeuvres the frame 20 between the first position and second position.

In an optional embodiment, the device 10 can include a roller actuator which when actuated causes rotational movement of the rollers 70 subsequently causing rotational movement of the vehicular component 30 retained within the frame 20.

Although the present invention has been described in terms of the presently preferred embodiments, it is to be understood that the disclosure is not to be interpreted as limiting. Various alterations and modifications will no doubt become apparent to those skilled in the art after having read the above disclosure. All such alterations and modifications should be considered within the spirit and scope of the invention as broadly herein before described.

The invention claimed is:

1. A device for changing the vehicular component on a first vehicle, the device including:

a frame for releasably receiving the vehicular component;

a mounting member operably coupled to the frame for allowing the device to be mounted to a second vehicle such that the second vehicle can position the device in a component changing position between coaxial axles of the first vehicle; and, a first actuator which when actuated moves the frame, whilst in the component changing position, relative to the mounting member and in a direction substantially parallel with the coaxial axles so as to move the frame between a first position and a second position to thereby mount the vehicular component on the first vehicle or receive the vehicular component from the first vehicle.

2. The device according to claim 1, wherein the device includes a support structure which is operably connected to the frame for supporting the frame.

3. The device according to claim 2, wherein the support structure is operably coupled to the mounting member via a movable plate, wherein actuation of the first actuator causes the movable plate to move relative to the mounting member, causing the support structure supporting the frame to move between the first position and second position.

4. The device according to claim 3, wherein the device includes a second actuator which is coupled between the movable plate and the support structure, wherein actuation of the second actuator causes the support structure supporting the frame to rotate about an axis of the movable plate, wherein the axis which the support structure supporting the frame rotates is orthogonal to a substrate surface supporting the device.

5. The device according to claim 4, wherein at least one of the first actuator and the second actuator, are a piston and cylinder arrangement.

6. The device according to claim 3, wherein the device includes at least one extension actuator provided between the support structure and the moveable plate, wherein actuation of the at least one extension actuator causes the support structure and frame to extend away from the moveable plate or move toward the moveable plate.

7. The device according to claim 3, wherein a first end of the first actuator is coupled to the mounting member and a second end of the first actuator is coupled to the movable plate, wherein the movable plate slidingly moves between opposing ends of the mounting member during actuation of the first actuator.

8. The device according to claim 2, wherein the device includes an elevation actuator operably connected between the support structure and the frame, wherein actuation of the elevation actuator adjusts an elevation of the frame relative to a support surface.

9. The device according to claim 8, wherein the elevation actuator is a piston and cylinder arrangement.

10. The device according to claim 9, wherein the flame is coupled to legs of the support structure via slidable members, wherein at least one of the slidable members is coupled to the respective leg of the support structure by the elevation actuator to enable the elevation of the frame to be adjusted via actuation of the elevation actuator.

11. The device according to claim 8, wherein the extension actuator is a piston and cylinder arrangement.

12. The device according to claim 2, wherein support structure is elongate to facilitate the positioning of the device between the coaxial axles.

13. The device according to claim 2, wherein the support structure includes at least one support wheel to allow movement of the device in multiple directions over a substrate surface.

14. The device according to claim 1 wherein the frame includes one or more support members which support the vehicular component within the frame, wherein at least some of the one or more support members include one or more rollers, wherein the one or more rollers facilitate rotation of the vehicular component within the frame.

15. The device according to claim 14, wherein the one or more rollers includes one or more support rollers which the vehicular component rests upon within the frame, and one or more retainment rollers which clamp against a portion of the vehicular component to urge the vehicular component against the support rollers to thereby facilitate retainment of the vehicular component within the frame.

16. The device according to claim 15, wherein the vehicular component is a wheel, wherein the one or more retainment rollers clamp against a ground engaging portion of the wheel to facilitate retainment of the wheel within the frame.

17. The device according to claim 15, wherein the device includes a retainment roller actuator, wherein actuation of the actuator causes the one or more retainment rollers to move between a disengaged position, wherein the vehicular component supported within the frame is able to be removed from the frame, and a retainment position, wherein the vehicular component is retained within the frame.

18. The device according to claim 15, wherein the device includes a plurality of retainment rollers and a plurality of support rollers, wherein at least two of the retainment rollers are diametrically opposed relative to a respective two of the support rollers.

19. The device according to claim 14, wherein the device includes a roller actuator, wherein actuation of the roller actuator causes the one or more rollers to rotate thereby facilitating rotational movement of the vehicular component within the frame.

20. The device according to claim 1, wherein the frame include a profile which substantially corresponds to profile of the vehicular component to facilitate retainment of the vehicular component within the frame.

21. The device according to claim 20, wherein the frame includes a profile which substantially corresponds to a wheel.

22. The device according to claim 1, wherein the device includes the a removeable cradle which when is, wherein the cradle is able to engage a vehicular component within the frame.

23. The device according to claim 22, wherein the cradle is engageable with an engine.

24. The device according to claim 22, wherein the cradle includes cradle engagement members which engage the cradle within the frame.

25. The device according to claim 24, wherein the device includes cradle fasteners to fasten the vehicular component to the cradle.

26. The device according to claim 1, wherein the device includes a locking member which is operably connected to the frame, wherein the locking member moves between an unclamped position, wherein the vehicular component is able to be released from the frame, and a clamped position facilitating retainment of the vehicular component within the frame.

27. The device according to claim 26, wherein the locking member in the retainment position causes the locking member to engage with a portion of the vehicular component to restrict rotation of the vehicular component within the frame.

28. The device according to claim 26, wherein the device includes a locking member actuator, wherein actuation of the locking member actuator causes the locking member to move between the unclamped position and the clamped position.

29. The device according to claim 2, wherein the device includes at least one rotational actuator operably connected between the support structure and the frame, wherein actuator of the at least one rotational actuator causes rotational movement of the frame relative to the support structure.

30. The device according to claim 29, wherein the rotational actuator is a piston and cylinder arrangement.

31. The device according to claim 1, wherein when the first actuator is actuated to move the frame to the first position, the frame is located distally from one of the coaxial axles of the first vehicle, and when the first actuator is actuated to move the frame to the second position, the frame is located adjacently the one of the coaxial axles of the first vehicle.

32. The device according to claim 1, wherein the frame is elongate such as to facilitate the frame being positioned between the coaxial axles of the first vehicle.

33. The device according to claim 1, wherein the second vehicle is a bulldozer, and the mounting member is a longitudinal plate having one or more apertures located in side portions extending orthogonally from the plate, wherein the plate is mountable with a grader of the bulldozer via the one or more apertures.

34. The device according to claim 1, wherein the frame includes a separable side bar member, wherein the separable side bar is moveable between a first position to facilitate release of the vehicular component from the frame, and a second position to facilitate retainment of the vehicular component within the frame.

* * * * *